US008317289B2

(12) United States Patent
Chrétien et al.

(10) Patent No.: US 8,317,289 B2
(45) Date of Patent: Nov. 27, 2012

(54) INLINE CALIBRATION OF CLEAR INK DROP MASS

(75) Inventors: Michelle N. Chrétien, Mississauga (CA); Peter Gordon Odell, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 394 days.

(21) Appl. No.: 12/757,415

(22) Filed: Apr. 9, 2010

(65) Prior Publication Data

US 2011/0249051 A1 Oct. 13, 2011

(51) Int. Cl.
*B41J 29/38* (2006.01)
*B42D 15/00* (2006.01)

(52) U.S. Cl. ..... 347/14; 283/85; 283/92

(58) Field of Classification Search ..... 347/14; 283/92

See application file for complete search history.

(56) References Cited

U.S. PATENT DOCUMENTS

| | | | | |
|---|---|---|---|---|
| 5,666,417 | A * | 9/1997 | Liang et al. | 283/92 |
| 7,645,014 | B2 * | 1/2010 | Kinas | 347/19 |
| 2009/0231378 | A1 | 9/2009 | Snyder et al. | |
| 2009/0237434 | A1 | 9/2009 | Mantell et al. | |

* cited by examiner

*Primary Examiner* — Uyen Chau N Le
*Assistant Examiner* — Kajli Prince
(74) *Attorney, Agent, or Firm* — Maginot, Moore & Beck, LLP

(57) ABSTRACT

An imaging device includes print media and a plurality of ink jets for ejecting drops of substantially clear ink onto the print media. One of the print media and the substantially clear ink has a fluorescent characteristic and the other of the print media and the substantially clear ink is substantially non-fluorescent. The imaging device includes a fluorescence sensor having (i) a light emitter for illuminating the print media and the drops of substantially clear ink ejected onto the media by the plurality of ink jets with light of an activating wavelength, and (ii) a light detector for detecting a fluorescence intensity of light received from the print media and the drops of substantially clear ink ejected onto the media in an emission wavelength. A controller is configured to modify an operating parameter of the imaging device based on the fluorescence intensity detected by the sensor.

5 Claims, 2 Drawing Sheets

INLINE CALIBRATION OF CLEAR INK DROP MASS

TECHNICAL FIELD

The present disclosure relates to ink-jet printing, particularly involving ink jet printing using clear or colorless inks.

BACKGROUND

Imaging devices, such as ink jet printers, typically include one or more printheads that have ink jets from which drops of ink are ejected onto an image receiving surface. The image receiving surface may comprise recording media, such as paper, transparency, and the like, or may comprise an intermediate imaging member, such as a rotating drum or belt. The ink jets include actuators that generate mechanical forces to expel ink drops through an ink jet nozzle onto the image receiving surface in response to an electrical voltage signal, sometimes called a driving signal. In general, the amplitude, or voltage level, of the ink jet drive signals determines the amount of ink ejected in each drop.

In order to form color images on the image receiving surface, the printheads of an ink jet printer are provided with one or more colors or shades of ink for the ink jets to eject onto the image receiving surface. Multicolor images having variations in color beyond the colors of ink used in a printer may be achieved by selectively depositing ink drops at the potential drop locations by using known dithering or halftoning techniques.

In addition to colored inks, some printheads of an imaging device may be provided with substantially colorless or clear ink for ejection by ink jets onto the image receiving surface. Clear ink may be ejected by ink jets on top of printed images to form an overcoat that protects the images from being smeared and also to provide a desired level of gloss for the media. Clear inks may be also be selectively applied, such as by halftoning or dithering, for a number of additional reasons including, for example, to reduce gloss differential between different portions of an image or print, to provide spot glossing, to embed "invisible" images or data into media, and the like.

For optimum image quality, the drop mass of the drops emitted by the ink jets of the printheads should be substantially the same, especially for printheads, or ink jets of the printheads, that utilize the same color or shade of ink, including clear ink. As is known in the art, variations in ink jet performance may cause the drop mass of drops emitted by different ink jets to vary from ink jet to ink jet within a printhead. Such variations in ink jet performance may also result in the average drop mass output by the ink jets of a printhead to vary from printhead to printhead. In color images, such drop mass variations may result in image quality defects such as banding or streaking in the colors of the images produced. When using clear ink, banding and streaking may be less noticeable but may still adversely affect the glossiness of the images produced.

As part of a setup or maintenance routine, the ink jets of an imaging device typically undergo a normalization or calibration process so that the ink jets of an imaging device generate ink drops having consistent and uniform drop mass. Such normalization processes typically involve adjusting or modifying the voltage level of the drive signals for the ink jets so that the drops generated have a desired drop mass.

To enable normalization of the drop mass of the drops produced by the ink jets of an imaging device, a baseline drop mass for the drops generated by the ink jets must first be determined. In some previously known systems, the baseline drop mass of drops emitted by the ink jets of an imaging device was determined by printing onto a recording sheet, such as a transparency, and measuring the weight of the recording sheet before and after the ink is deposited onto the sheet. The weight difference between the printed and non-printed sheet corresponds to the total weight of the ink on the sheet which may then divided by the total number of drops printed onto the sheet to arrive at the average drop mass for the ink jets used to print onto the sheet. Based on the determined average drop mass using the printed sheets, the drive signals for actuating the ink jets may be calibrated to adjust the drop mass of the drops produced by a printhead to be within specifications. While such a method is capable of determining an average drop mass output by ink jets, such techniques are typically only available for use at the factory, not in the field. In addition, such a method may require several iterations and huge amounts of resources, i.e., time, transparencies, and ink, to calibrate the overall drop mass in a printhead.

Another method of determining drop mass that has been used in some previously known systems involves printing test patterns onto an image receiving surface and scanning the test pattern with an image sensor. Such image sensors typically include a light source for illuminating the test pattern and light detector for measuring a reflectance of light from the test pattern. The measured reflectance value of the test pattern may be correlated to a drop mass for the drops used to form the test pattern. The magnitude of the reflectance from the test may be correlated to drop mass values for the ink jets. If the detected drop mass is not within specifications, the voltage level, or amplitude, of one or more segments, or pulses, of the driving signal ink jet may be selectively adjusted (if needed so that each ink jet of a printhead emits drops having substantially the same drop mass.

Because such previously known normalization processes rely on reflectance measurements to determine drop mass, they require that the ink drops used to form the test patterns have some form of colorant that is capable of reflecting light in a detectable manner. Clear ink, however, does not reflect light in the same manner as colored ink. Consequently, in order to normalize the ink jets of a printhead unit intended for use with clear ink using the previously known reflectance based normalization process, the printhead unit would have to first be filled with a colored ink so it could be normalized and then cleaned so that it could be filled with the appropriate clear ink which poses the risk of color contamination of the clear ink.

SUMMARY

A clear ink drop mass calibration system has been developed that may be incorporated into an imaging device and that enables clear ink drop mass to be detected and calibrated automatically without requiring the use of colored inks or extensive time and resources. In particular, in one embodiment, an imaging device in which such a clear ink drop mass calibration system is incorporated includes print media and a plurality of ink jets for ejecting drops of substantially clear ink onto the print media. One of the print media and the substantially clear ink has a fluorescent characteristic and the other of the print media and the substantially clear ink is substantially non-fluorescent. The imaging device includes a fluorescence sensor having (i) a light emitter for illuminating the print media and the drops of substantially clear ink ejected onto the media by the plurality of ink jets with light of an activating wavelength, and (ii) a light detector for detecting a fluorescence intensity of light received from the print media and the drops of substantially clear ink ejected onto the media in an emission wavelength. A controller is configured to modify an operating parameter of the imaging device based on the fluorescence intensity detected by the sensor.

In another embodiment, A method of operating an imaging device includes providing print media and substantially clear ink wherein one of the print media and the substantially clear ink has a fluorescent characteristic and the other of the print media and the substantially clear ink is substantially non-fluorescent, the fluorescent characteristic enabling the one to emit light at an emission wavelength in response to being illuminated by light at an activating wavelength with the activating wavelength being different than the emission wavelength. The print media is transported along a media path having a plurality of ink jets associated therewith, and the plurality of ink jets are actuated to eject drops of the substantially clear ink onto the print media. Light of the activating wavelength is directed toward the print media and the drops of the substantially clear ink on the print media, and a fluorescence intensity of light received from the print media and the drops of the substantially clear ink on the print media in the emission wavelength is detected. An operating parameter of the imaging device is then modified based on the detected fluorescence intensity.

DETAILED DESCRIPTION

Figure 1:
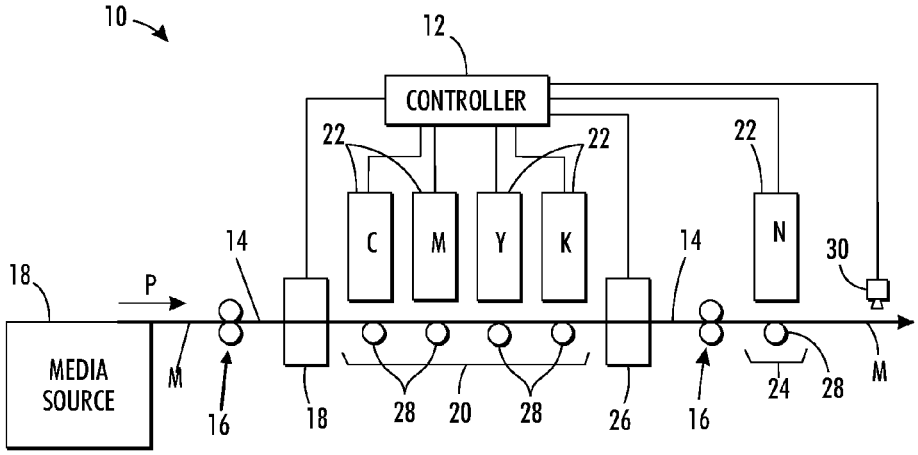
FIG. 1 is a simplified schematic view of an imaging device that includes a clear ink drop mass calibration system.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which the substrate onto which the image is transferred moves through the imaging device. The cross-process direction, along the same plane as the substrate, is substantially perpendicular to the process direction.

The present disclosure is directed to a system and method for inline calibration of clear ink drop mass in imaging devices without requiring the use of colored ink. In one embodiment, the calibration system is configured to utilize the intrinsic fluorescence found in most print media, in particular, paper media, by printing clear ink test patches onto the fluorescent print media and scanning the clear ink test patches with an inline fluorescence sensor incorporated into the imaging device to detect or measure the fluorescence intensity of the print media surrounding or underlying the test patches. The detected fluorescent intensity may be correlated to the average drop mass of the clear ink drops used to form the test patches. Based on the drop mass detected in this manner, one or more operating parameters of the printheads or ink jets of the printheads may be adjusted or modified so that the ink jets produce drops with a desired drop mass. For example, the drive signals for actuating the ink jets of the printheads may be calibrated to adjust the drop mass of the drops by the ink jets to be within specifications. In one embodiment, the drop mass of drops output by the ink jets may be calibrated by increasing the voltage level, or amplitude, of the drive signals for the ink jets to increase drop mass and by decreasing the voltage level, or amplitude, of the drive signals for the ink jets to decrease drop mass.

As is known in the art, the fluorescence property of a material refers to, for example, the property of giving off light at a particular wavelength (referred to herein as the emission wavelength or radiation) when illuminated by light of a different wavelength (referred to herein alternately as the excitation wavelength, excitation radiation, activation wavelength, or activation radiation). The activating wavelength or radiation may be in the ultraviolet (UV), visible or infrared regions, although the use of activating radiation in the UV region (from about 100 nm to about 400 nm) is most common. Most print media, especially paper print media, is intrinsically fluorescent because, during the papermaking process, a variety of cleaning and bleaching steps are performed by paper manufacturers on paper pulp in order to increase the whiteness of the paper. Despite cleaning and bleaching, all conventional papers exhibit slightly lower reflectance in the blue region of the spectrum, and, therefore appear to the human eye to be slightly yellow or tan in color. For this reason, most paper print media contain one or more additives generally referred to as fluorescent whitening agents (FWA) or, more generally, "whiteners". These additives, added early in the papermaking process, absorb light in the ultraviolet (UV) portion of the spectrum (including wavelengths of 330-390 nm) that is reemitted in the visible band, including the blue portion of the spectrum (e.g., at wavelengths of 400-500 nm). This makes the manufactured paper appear whiter, and color images printed thereon appear more saturated and therefore more colorful.

The clear ink drop mass calibration system is configured to determine clear ink drop mass by printing test patches onto the fluorescent print media with a non-fluorescent clear ink. As used herein, the term "non-fluorescent" used in connection with a material, such as ink, refers to the lack of ability of the material to fluoresce when illuminated by an activating radiation. To print a "test patch" on the fluorescent print media, the ink jets of the printhead or printheads that utilize clear ink are actuated to eject drops of clear ink onto the print media to form a layer of clear ink on the surface of the drum having a width in the cross-process direction corresponding substantially to the width of the printhead. Surface energy properties of the clear ink on the print media cause the clear ink drops to coalesce to a substantially uniform thickness that corresponds substantially to the drop mass of the drops used to form the test band.

The clear ink drops of a test patch mask or suppress the intensity of the fluorescence of the underlying print media in a manner that corresponds to the thickness of the layer of clear ink of the test patch. Accordingly, the drop mass of the clear ink drops used to form a test patch may be determined by illuminating the test patches with a suitable activating radiation selected based on the fluorescent properties of the print media and detecting or sensing the intensity of the fluorescence of light from the test patch with an optical detector tuned to the wavelength range of the media fluorescence. The magnitude of the detected fluorescence intensity may then be correlated to a drop mass value for the clear ink drops used to form the test pattern which in turn enables calibration of the clear ink drop mass.

In another embodiment, a clear ink calibration system is configured to calibrate clear ink drop mass by printing clear ink test patches onto a non-fluorescent media, or surface, using a clear ink having a fluorescent or infrared property. This embodiment is similar to the previous embodiment in that the fluorescence or infrared intensity of the drops of clear ink is detected and correlated to a drop mass for the drops. However, in this embodiment, the correlation between the detected fluorescence or infrared intensity and the clear ink drop mass is in the opposite sense in that the fluorescence or infrared intensity increases as drop mass increases whereas the fluorescence intensity decreases with increasing drop mass in the fluorescent media/non-fluorescent ink embodiment.

In one embodiment, clear ink suitable for using against a non-fluorescent media or surface may be provided by adding an ultraviolet (UV) or infrared (IR) sensitive material to clear ink. Such additives do not substantially affect the appearance of the clear ink under ambient light conditions. The clear ink may comprise any suitable type of ink to which has been added a UV or IR sensitizer including clear phase change ink and clear UV curable ink. An image sensor is provided for illuminating the clear ink test patches with an activating radiation in wavelengths suitable for the type of clear ink, or type of sensitizing agent used in the clear ink. For example, the image sensor is configured to illuminate clear ink having a UV sensitizer with a suitable activating radiation in the UV spectrum, and to illuminate clear ink having an IR sensitizer with a suitable activating radiation in the IR spectrum. The image sensor is configured to detect the fluorescence intensity or infrared intensity of the clear ink when illuminated by the activating radiation. The magnitude of the detected fluorescence intensity or infrared intensity may then be correlated to a drop mass value for the clear ink drops used to form the test pattern which in turn enables calibration of the clear ink drop mass.

Turning now to the drawings, FIG. 1 illustrates a simplified schematic diagram of an imaging device 10 in which is incorporated a clear ink drop mass calibration system according to one embodiment of the present disclosure. As depicted, the imaging device 10 includes a media transport system that is configured to transport print media 14 in a process direction P from a media source 18 along a media path M past various systems and devices of the imaging device 10, such as colored ink printing station 20 and clear ink printing station 24. The media 14 may comprise any suitable type of media, such as paper, and may comprise individual sheets of print media, also referred to as cut sheet media, or a very long, i.e., substantially continuous, web of media, also referred to as a media web. When cut sheet media is used, the media source 18 may comprise one or more media trays as are known in the art for supplying various types and sizes of cut sheet media. When the print media 14 comprises a media web, the media source may comprise a spool or roll of media. The media transport system includes suitable devices, such as rollers 16, as well as baffles, deflectors, and the like (not shown), for transporting the media 14 along media path M in the imaging device 10.

As depicted in FIG. 1, the media transport system is configured to transport the print media M through a colored ink printing station 20 which includes a series of printhead units 22 arranged across the media path M in the cross-process direction that are configured to deposit marking material of a particular color onto the print media. A separate printhead unit or group of printhead units may be provided for each color of marking material used in the printing system. In the embodiment of FIG. 1, the imaging device is configured to use four colors of marking material, e.g., cyan, magenta, yellow, and black (CYMK), although more or fewer colors or shades, including colors than CMYK, may be used. For simplicity, a single printhead unit 22 is shown for each of the four primary colors—CMYK. Any suitable number of printhead units for each color of ink, however, may be employed.

In one embodiment, the marking material utilized in the imaging device 10 is a "phase-change ink," by which is meant that the ink is substantially solid or gelatinous at room temperature and substantially liquid when heated to a phase change ink melting temperature for jetting onto the print media or imaging member. The phase change ink melting temperature may be any temperature that is capable of melting solid phase change ink into liquid or molten form. In one embodiment, the phase change ink melting temperature is approximately 100° C. to 140° C. In alternative embodiments, marking materials other than phase change ink may be utilized including, for example, aqueous ink, oil-based ink, UV curable ink, or the like.

In addition to the color printing station 20, the imaging device includes a clear ink printing station 24 that includes at least one printhead unit 22 for emitting substantially colorless or clear marking material or ink onto the print media M. Substantially clear ink herein refers to, for example, a substantially clear marking material ink that has minimal impact on the final printed color, regardless of whether or not the ink is devoid of all colorant. In one embodiment, the clear ink utilized for the coating ink comprises a phase change ink formulation without colorant. Alternatively, the clear ink may comprise a reduced set of typical solid ink components or a single solid ink component, such as polyethylene or polymethylene wax. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Various media conditioning devices and systems may be positioned along the media path M of the imaging device for controlling and regulating the temperature of the print media 14 as well as the ink deposited thereon. For example, in the embodiment of FIG. 1, a preheating system 18 may be provided along the media path for bringing the print media to an initial predetermined temperature prior to reaching the printing station 20. The preheating system 18 can rely on contact, radiant, conductive, or convective heat to bring the media to a target preheat temperature, which in one practical embodiment, is in a range of about 30° C. to about 70° C.

Following the printing station along the media path may be positioned a fixing system 26 that is configured to apply heat and/or pressure to the media to fix ink to the media. The fixing system 26 may include any suitable device or apparatus for fixing images to the media including heated or unheated pressure rollers, radiant heaters, heat lamps, and the like. In the embodiment of FIG. 1, the fixing system 26 includes a "spreader", that applies a predetermined pressure, and in some implementations, heat, to the media. The function of the spreader is to take what are essentially droplets, strings of droplets, or lines of ink on web W and smear them out by pressure, and, in one embodiment, heat, so that spaces between adjacent drops are filled and image solids become uniform. In addition to spreading the ink, the spreader may also improve image permanence by increasing ink layer cohesion and/or increasing the ink-web adhesion. In addition to the spreader, the fixing system may include additional heating and pressure devices for equalizing ink and media temperatures as well as bringing the ink and media temperatures to a temperature suitable for fixing at the fixing system 26.

In addition, a backing member 28 may be associated with each printhead unit 22 which is typically in the form of a bar or roll arranged substantially opposite the printhead units 22 on the other side of media 14. Each backing member 28 is used to position the media 14 so that the gap between the printhead and the sheet stays at a known, constant distance. Each backing member may be configured to emit thermal energy to aid in heating the media to a desired temperature which, in one practical embodiment, of about 40° C. to about 60° C. The preheater 18, the printheads, backing members 24 (if heated), as well as the surrounding air combine to maintain the print media in a predetermined temperature range which may be, for example, about 40° C. to 70° C.

As depicted in FIG. 1, the clear ink printing station 24 is positioned downstream, or after, the fixing system 26 in the process direction P of the print media M to deposit clear ink on top of the ink images formed on the media at the printing station 20 and fixed to the web at fixing system 26. The clear ink printing station may be used to form a clear protective coating over the images to prevent damage to the ink images on the media, such as smearing, flaking, or offsetting of the ink. The clear ink may also be used to impart a desired glossiness to all or select portions of the printed media as well as to reduce differential gloss. The clear ink may be ejected at a select density or halftone level so that the resulting clear ink coating has a desired level of coverage or a desired gloss level. Although not depicted in FIG. 1, a further fixing system, similar to fixing system 26, may be positioned along the media path to fix the clear ink to the media after the clear ink is deposited on the media at the clear ink printing station 24. In alternative embodiments, the clear ink printing station 24 may be incorporated into the printing station 20 to deposit clear ink onto the media prior to the media reaching the fixing system 26.

Operation and control of the various subsystems, components and functions of the imaging device 10 are performed with the aid of a controller 12. The controller 12 may be a self-contained, dedicated computer system having a central processor unit (CPU) 32, electronic storage or memory 34, and a display or user interface (UI) (not shown). The controller 12 receives and manages image data flow between image input sources (not shown), which may be a scanning system or a work station connection, and the printhead units 22. The controller 12 generates control signals that are delivered to the components and subsystems. These control signals, for example, include drive signals for actuating the ink jets of the printheads 22 to eject drops in timed registration with each other and with the movement of the print media 14 to form images thereon.

Each of the printhead units 22 of the color and clear ink printing stations includes a plurality of ink jets for emitting drops of the corresponding colored or colorless ink onto the print media. In one embodiment, the ink jets of a printhead unit may be provided in multiple smaller printheads that are arrayed effectively end-to-end across the media in one or more print bars. Alternatively, the ink jets of a printhead unit 22 may be arranged in a single printhead that extends substantially across the entire width of the media. The ink jets of the printheads are configured to emit drops of ink in response to drive signals. In one embodiment, the ink jets of the printheads comprise piezoelectric ink jets. As is known in the art, a piezoelectric ink jet includes an ink filled pressure chamber upon which a piezoelectric transducer is arranged. The pressure chamber is connected to a channel or passageway that extends through a corresponding nozzle in the nozzle plate of the printhead. The piezoelectric transducer produces pressure pulses in the chamber in response to the application of a drive signal that cause drops of ink to be emitted through the nozzle.

Figure 2:
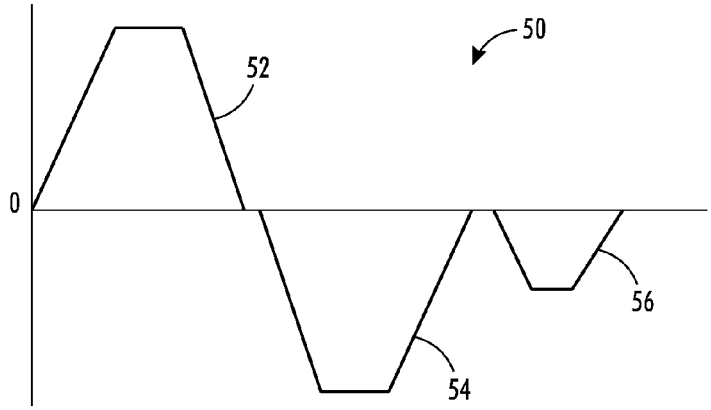
FIG. 2 depicts a waveform for actuating the ink jets of the imaging device to eject drops of ink.

An exemplary driving signal 50 for the ink jets of the printheads is illustrated in FIG. 2. The drive signal 50 of FIG. 2 is a waveform that includes a fill pulse 52 and an ejection pulse 54. The pulses 52 and 54 are voltages of opposite polarity which may be the same or approximately the same magnitude. The polarities of the pulses 52, 54 may be reversed from that shown in FIG. 2, depending upon the polarization of the piezoelectric transducer. In operation, upon the application of the fill pulse 52, the ink chamber expands and draws ink into the chamber for filling the chamber following the ejection of a drop. As the voltage falls toward zero at the end of the fill pulse, the ink chamber begins to contract and moves the ink meniscus toward an orifice or nozzle of an ink jet. Upon the application of the eject pulse 54, the ink chamber is rapidly constricted to cause the ejection of a drop of ink. In addition to the fill and eject pulses, the drive signal of FIG. 2 may include a reset pulse 56. The reset pulse 56 occurs after a drop is emitted and may function to reset the ink jet so that subsequent drops have substantially the same mass and substantially the same velocity as the previously emitted drop. The reset pulse 56 may be of the same polarity as the preceding pulse 56 in order to "pull" the meniscus at the nozzle inwardly to help prevent the meniscus from breaking. If the meniscus breaks and ink oozes out of the nozzle, the ink jet can fail to emit drops on subsequent firings.

Figure 3:
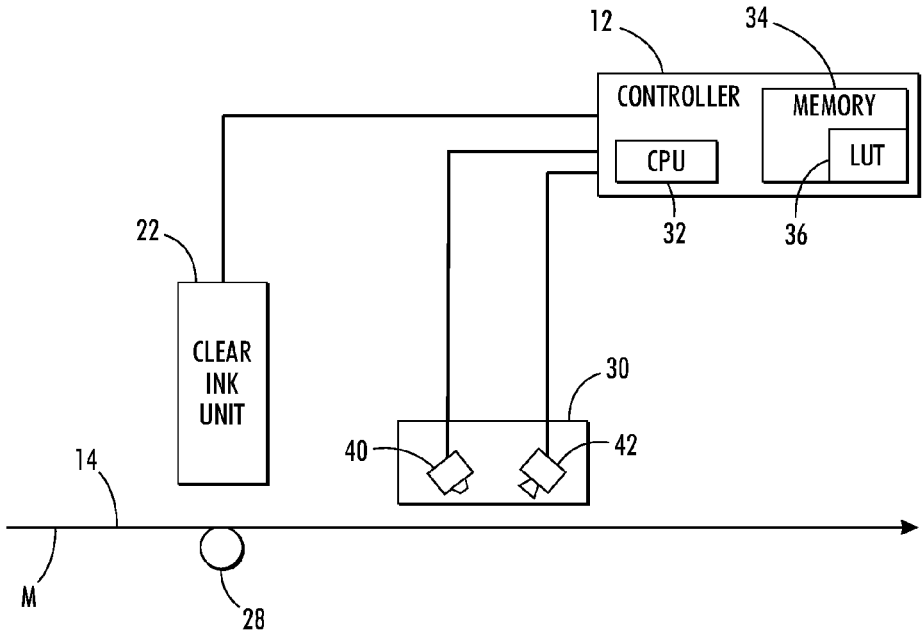
FIG. 3 is a schematic view of an embodiment of the clear ink drop mass calibration system of FIG. 1.

As mentioned above, an important factor in the quality of the images produced by the imaging device is the drop mass of the drops produced by the ink jets. Systems and methods for inline calibration of drop mass for ink jets that emit colored ink are generally not applicable to ink jets that emit clear ink. To enable the calibration of the ink jets that eject drops of clear ink, the imaging device 10 is provided with a clear ink drop mass calibration system 100. An embodiment of such a system 100 is shown in FIG. 3. As depicted, the system 100 includes an image sensor 30 positioned along the media path M downstream from the clear ink printing station 24. The image sensor is operable to detect or measure an intensity of light received from the surface of the media.

In one embodiment, the clear ink calibration system 100 is configured to use the fluorescence of the print media 14 to enable clear ink drop mass calibration by printing onto the media with a non-fluorescent clear ink. Accordingly, in this embodiment, the print media 14 is a fluorescent print media configured to re-emit light at an emission wavelength in response to being illuminated by light of an activation wavelength different than the emission wavelength. Activation and emission wavelengths for a given fluorescent media may be determined in any suitable manner. In addition, the clear ink used to calibrate drop mass is non-fluorescent so that when it is deposited onto the fluorescent media, the clear ink masks or suppresses the intensity of the light fluoresced by the media in its emission wavelength in a predictable manner.

In the fluorescent media/non-fluorescent clear ink embodiment, the image sensor includes a light emitter 40 configured to emit light toward the print media in at least the activating wavelength for the print media, which may be in the UV, visible, or infrared portions of the spectrum. In one embodiment, the activating wavelength for the print media is in the UV spectrum. The light emitter 40 may comprise a plurality of light emitting diodes (LEDs) arrayed across the media path for emitting the activating radiation. Alternately, the light emitter may comprise a single LED coupled to a light pipe that conveys light generated by the LED to one or more openings in the light pipe. Any suitable light emitter or light source, however, may be used to direct the activating radiation toward the print media. The light emitter is operably coupled to the controller so that the controller may time the activation of the light emitter to output the activating radiation onto clear ink test patches formed on the print media 14 by the clear ink printhead unit 22.

The fluorescence sensor 30 includes a light detector 42 that is configured to detect or sense the intensity of the light in the emission wavelength remitted by the print media in response to the activating radiation. The light detector 42 may be any suitable device or apparatus capable of detecting light fluoresced by the print media in the emission wavelength of the print media, which is typically in the blue portion of the spectrum, although not necessarily. The light detector 42, in one embodiment, is a linear array of photosensitive devices, such as charge coupled devices (CCDs). The photosensitive devices generate an electrical signal corresponding to the intensity or amount of light received by the photosensitive devices, i.e., emitted from the print media in response to the activating radiation.

To enable detection of a drop mass value for the clear ink jets, the controller 12 is configured to actuate the ink jets of the clear ink printhead unit to form at least one clear ink test patch on the print media. The print media is then transported past the image sensor 30 where the controller 14 activates the light emitter to direct an activating radiation onto the clear ink test patch formed on the print media, and the light detector generates signals that are output to the controller 12 that are indicative of the intensity of the emitted light from the print media. The clear ink test patch acts to suppress the intensity of the emitted light from the print media detected by the light detector in a manner that corresponds substantially to the drop mass of the drops used to form the test patch. For example, the greater the drop mass, the greater the suppression of the fluorescence intensity, and vice versa. Accordingly, based on the detected fluorescence intensity of the test patch, or the print media underlying the test patch, a correlation may be made as to the drop mass of the clear ink drops used to form the test patch.

In use, the controller may be configured to determine an average drop mass value for the clear ink jets based on the fluorescence intensity measurements of the fluorescence sensor in any suitable manner. In one embodiment, the controller 12 is provided with a lookup table (LUT) 36 stored in memory that is populated with drop mass values and associated fluorescence intensity measurement values for a given media type. The controller 12 is configured to access the LUT 36 using the fluorescence intensity measurement indicated by the fluorescence sensor 30 to determine the average drop mass value associated therewith. Alternatively, the controller 12 may be configured to implement a suitable algorithm or routine for calculating the drop mass based on a fluorescence intensity measurement.

Based on the detected average drop mass, one or more operating parameters of the clear ink printheads or ink jets of the clear ink printheads may be adjusted or modified so that the ink jets produce drops with a desired drop mass. For example, the drive signals for actuating the ink jets of the printheads may be calibrated to adjust the drop mass of the drops produced by a printhead to be within specifications. In one embodiment, the drop mass of drops output by the ink jets may be calibrated by increasing or decreasing the voltage level, or amplitude, of the one or more of the pulses 52, 54, 56 of the drive signals 50 for the ink jets.

In another embodiment, the clear ink calibration system 100 is configured to calibrate clear ink drop mass by printing clear ink test patches onto a non-fluorescent media, or surface, using a clear ink having a fluorescent or infrared property. Accordingly, in this embodiment, the print media 14 is substantially non-fluorescent, and the clear ink used to form the test patches on the print media includes an ultraviolet (UV) or infrared (IR) sensitive material. In embodiments, the UV or IR sensitive material is any UV or IR sensitive material that does not significantly impact or alter the perception or visibility of the clear ink under ambient light conditions. The UV or IR sensitive material is sensitive to an activating radiation, for example a radiation having a wavelength from about 10 nm to about 1,000 nm, such as from about 10 nm to about 400 nm (the UV light range) or from about 700 nm to about 1,000 nm (the IR light range). The activating radiation may thus be in the ultraviolet (UV) or infrared (IR) regions. The UV or IR sensitive material is configured to remit light in an emission wavelength for the particular activating radiation that may be in the UV, visible, IR regions of the spectrum. In this embodiment, the image sensor a light emitter 40 configured to emit light toward the print media in at least the activating wavelength of the clear ink, or more specifically, the activating wavelength of the UV or IR sensitizer in the clear ink, and the sensor 30 includes a light detector 42 that is configured to detect or sense the intensity of the light in the emission wavelength of the UV or IR sensitizing agent in the clear ink.

Similar to the fluorescent media/non-fluorescent ink embodiment, the controller is configured to correlate the measured fluorescence or infrared intensity of the clear ink test patches to a drop mass value for the jets used to form the patches. Based on the detected average drop mass, one or more operating parameters of the clear ink printheads or ink jets of the clear ink printheads may be adjusted or modified so that the ink jets produce drops with a desired drop mass.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging device comprising:

a source of print media having a fluorescent characteristic, the fluorescent characteristic enabling the print media to emit light at an emission wavelength in response to being illuminated by light at an activating wavelength, the activating wavelength being different than the emission wavelength;

a media transport system configured to transport the print media along a media path;

a plurality of ink jets, each ink jet in the plurality of ink jets being configured to eject drops of substantially clear ink in response to a drive signal, the plurality of inkjets being associated with the media path for ejecting drops of substantially clear ink onto the print media; and a fluorescence sensor associated with the media path, the fluorescence sensor including (i) a light emitter for illuminating the print media and the drops of substantially clear ink ejected onto the media by the plurality of ink jets with light of the activating wavelength, and (ii) a light detector for detecting a fluorescence intensity of light received from the print media and the drops of substantially clear ink ejected onto the print media in the emission wavelength, the fluorescent intensity corresponding to a drop mass value for the drops of clear ink ejected onto the print media by the plurality of ink jets, the fluorescence sensor being configured to output signals indicative of the detected fluorescence intensity; and a controller operable to receive the signals from the fluorescence sensor, the controller being configured to modify at least a portion of at least one drive signal of the plurality of ink jets based on the drop mass value indicated by the fluorescence sensor.

2. A method of operating an imaging device comprising:

providing a print media, which has a fluorescent characteristic, and a substantially clear ink, which is substantially non-fluorescent molten phase change ink or substantially non-fluorescent UV curable ink, the fluorescent characteristic enabling the print media to emit light at an emission wavelength in response to being illuminated by light at an activating wavelength, the activating wavelength being different than the emission wavelength;

transporting the print media along a media path having a plurality of ink jets associated therewith;

actuating with drive signals the plurality of ink jets to eject drops of the substantially clear ink onto the print media;

directing light of the activating wavelength toward the print media and the drops of the substantially clear ink on the print media;

detecting a fluorescence intensity of light received from the print media and the drops of the substantially clear ink on the print media in the emission wavelength; and modifying drive signals for the plurality of ink jets based on the detected intensity.

3. The method of claim 2, the modification of the drive signals further comprising:

modifying the drive signals of the plurality of ink jets to increase or decrease a drop mass of drops ejected by the plurality of ink jets based on the detected intensity.

4. The method of claim 2, the print media comprising a substantially continuous web of media.

5. The method of claim 2, the print media comprising cut sheet media.

* * * * *